US009780476B2

(12) United States Patent
Guo

(10) Patent No.: US 9,780,476 B2
(45) Date of Patent: Oct. 3, 2017

(54) ELECTRICAL CONNECTOR HAVING IMPROVED TERMINAL ARRANGEMENT

(71) Applicant: FOXCONN INTERCONNECT TECHNOLOGY LIMITED, Grand Cayman (KY)

(72) Inventor: Jing-Jie Guo, Huaian (CN)

(73) Assignee: FOXXONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/182,880

(22) Filed: Jun. 15, 2016

(65) Prior Publication Data

US 2016/0372870 A1 Dec. 22, 2016

(30) Foreign Application Priority Data

Jun. 16, 2015 (CN) ..... 2015 1 0331752

(51) Int. Cl.
*H01R 13/26* (2006.01)
*H01R 24/60* (2011.01)
*H01R 107/00* (2006.01)

(52) U.S. Cl.
CPC ..... *H01R 13/26* (2013.01); *H01R 24/60* (2013.01); *H01R 2107/00* (2013.01)

(58) Field of Classification Search
CPC ..... H01R 24/60
USPC ..... 439/218
See application file for complete search history.

(56) References Cited

U.S. PATENT DOCUMENTS 9,478,905 B2 * 10/2016 Golko ..... H01R 13/516
2013/0115817 A1 5/2013 Terlizzi et al.
2015/0340791 A1 * 11/2015 Kao ..... H01R 13/42 439/676

FOREIGN PATENT DOCUMENTS

CN 203859265 U 10/2014
CN 204205198 U 3/2015

* cited by examiner

*Primary Examiner* — Ross Gushi
(74) *Attorney, Agent, or Firm* — Wei Te Chung; Ming Chieh Chang

(57) ABSTRACT

An electrical connector includes an insulative housing having a tongue portion, and two rows of terminals reversely-symmetrically arranged at opposite faces of the tongue portion. Each row of terminals include a grounding terminal and a power terminal arranged at a first district, and at least one subsidiary terminal arranged at a second district connecting the first district. Each row of terminals lack of at least two terminals to thereby form a vacant space between the grounding terminal and the power terminal. The subsidiary terminals in the two rows are offset with each other along an up-to-down direction.

14 Claims, 15 Drawing Sheets

| A1 | A2 | A3 | A4 | A5 | A6 | A7 | A8 | A9 | A10 | A11 | A12 |
|---|---|---|---|---|---|---|---|---|---|---|---|
| | | | | CC1 | D+ | D- | | Vbus | | | GND |
| GND | | | Vbus | | D- | D+ | CC2 | | | | |
| B12 | B11 | B10 | B9 | B8 | B7 | B6 | B5 | B4 | B3 | B2 | B1 |

| A1 | A2 | A3 | A4 | A5 | A6 | A7 | A8 | A9 | A10 | A11 | A12 |
|---|---|---|---|---|---|---|---|---|---|---|---|
| | | | | CC1 | D+ | D− | | Vbus | | | GND |
| GND | | | Vbus | | D− | D+ | CC2 | | | | |
| B12 | B11 | B10 | B9 | B8 | B7 | B6 | B5 | B4 | B3 | B2 | B1 |

FIG. 5

| A1 | A2 | A3 | A4 | A5 | A6 | A7 | A8 | A9 | A10 | A11 | A12 |
|---|---|---|---|---|---|---|---|---|---|---|---|
| GND | | | | CC1 | D+ | D− | | Vbus | | | |
| | | | Vbus | | D− | D+ | CC2 | | | | GND |
| B12 | B11 | B10 | B9 | B8 | B7 | B6 | B5 | B4 | B3 | B2 | B1 |

FIG. 6

| A1 | A2 | A3 | A4 | A5 | A6 | A7 | A8 | A9 | A10 | A11 | A12 |
|---|---|---|---|---|---|---|---|---|---|---|---|
| | | | Vbus | CC1 | D+ | D− | | | | | GND |
| GND | | | | | D− | D+ | CC2 | Vbus | | | |
| B12 | B11 | B10 | B9 | B8 | B7 | B6 | B5 | B4 | B3 | B2 | B1 |

FIG. 7

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | | | | | |
| | | | | | D− | D+ | CC2 | Vbus | | | GND |
| B12 | B11 | B10 | B9 | B8 | B7 | B6 | B5 | B4 | B3 | B2 | B1 |

FIG. 8

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | | | | Vbus | | | GND |
| GND | | | Vbus | | | | CC2 | Vbus | | | GND |
| B12 | B11 | B10 | B9 | B8 | B7 | B6 | B5 | B4 | B3 | B2 | B1 |

FIG. 9

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | | | RFU1 | Vbus | | | GND |
| GND | | | Vbus | RFU2 | | | CC2 | Vbus | | | GND |
| B12 | B11 | B10 | B9 | B8 | B7 | B6 | B5 | B4 | B3 | B2 | B1 |

FIG. 10

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D- | | Vbus | | | GND |
| GND | | | Vbus | | D- | D+ | CC2 | Vbus | | | GND |
| B12 | B11 | B10 | B9 | B8 | B7 | B6 | B5 | B4 | B3 | B2 | B1 |

FIG. 11

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | D+ | D− | RFU1 | Vbus | | | GND |
| GND | | | Vbus | RFU2 | D− | D+ | CC2 | Vbus | | | GND |
| B12 | B11 | B10 | B9 | B8 | B7 | B6 | B5 | B4 | B3 | B2 | B1 |

FIG. 12

| A1 | A2 | A3 | A4 | A5 | A6 | A7 | A8 | A9 | A10 | A11 | A12 |
|---|---|---|---|---|---|---|---|---|---|---|---|
| GND | | | Vbus | | D+ | D- | RFU1 | Vbus | | | GND |
| GND | | | Vbus | RFU2 | | | | Vbus | | | GND |
| B12 | B11 | B10 | B9 | B8 | B7 | B6 | B5 | B4 | B3 | B2 | B1 |

FIG. 13

| A1 | A2 | A3 | A4 | A5 | A6 | A7 | A8 | A9 | A10 | A11 | A12 |
|---|---|---|---|---|---|---|---|---|---|---|---|
| GND | | | Vbus | CC1 | | | | Vbus | | | GND |
| GND | | | Vbus | | | | CC2 | Vbus | | | GND |
| B12 | B11 | B10 | B9 | B8 | B7 | B6 | B5 | B4 | B3 | B2 | B1 |

FIG. 14

| A1 | A2 | A3 | A4 | A5 | A6 | A7 | A8 | A9 | A10 | A11 | A12 |
|---|---|---|---|---|---|---|---|---|---|---|---|
| GND | | | Vbus | | | | RFU1 | Vbus | | | GND |
| GND | | | Vbus | RFU2 | | | | Vbus | | | GND |
| B12 | B11 | B10 | B9 | B8 | B7 | B6 | B5 | B4 | B3 | B2 | B1 |

FIG. 15

ELECTRICAL CONNECTOR HAVING IMPROVED TERMINAL ARRANGEMENT

BACKGROUND OF THE INVENTION

1. Field of the Invention

The present invention relates to an electrical connector, and more particularly to a USB (Universal Serial Bus) connector adapted for being normally and reversely mated with a mating plug.

2. Description of Related Art

China Patent No. 203859265, issued on Oct. 1, 2014, discloses a USB receptacle connector including an insulative housing and two rows of terminals. Each row of terminals include two positive power terminals and two grounding terminals positioned at opposite sides of the two positive power terminals. Such connector is not intended to transfer multiple signals.

China Patent No. 204315752, issued on May 6, 2015, discloses a USB receptacle connector including an insulative housing and two rows of terminals. Each row of terminals include a detecting terminal, a pair of USB 2.0 signal terminals, a power terminal, and a grounding terminal. The power and grounding terminals are positioned at a same side of the detecting terminal and the pair of USB 2.0 signal terminals and beyond the detecting terminal.

A USB receptacle connector having a new terminal arrangement is desired.

SUMMARY OF THE INVENTION

An electrical connector includes an insulative housing having a tongue portion, and two rows of terminals reversely-symmetrically arranged at opposite faces of the tongue portion. Each row of terminals includes a grounding terminal and a power terminal arranged at a first district, and at least one subsidiary terminal arranged at a second district connecting with the first district. Each row of terminals lack of at least two terminals to thereby form a vacant space between the grounding terminal and the power terminal. The subsidiary terminals in the two rows are offset with respect to each other along an up-to-down direction.

An electrical connector comprises: an insulative housing having an insertion cavity defining twelve terminal positions at opposite sides; and two rows of terminals arranged at the opposite sides of the insertion cavity, each terminal having a curved contact portion, each row of terminals comprising a first and a second grounding terminals, a first and a second power terminals, and a subsidiary terminal arranged adjacent to a middle of the insertion cavity along a transverse direction, each row of terminals lacking of two terminals to thereby form a first vacant space between the first grounding terminal and the first power terminal, and lacking of another two terminals to thereby form a second vacant space between the second grounding terminal and the second power terminal, said subsidiary terminals in the two rows being offset and reversely-symmetrically arranged.

Other novel features of the invention will become more apparent from the following detailed description when taken in conjunction with the accompanying drawings.

BRIEF DESCRIPTION OF THE DRAWINGS

FIG. 5 is a perspective view showing the terminal arrangement in the first embodiment;

FIG. 6 is a perspective view showing the terminal arrangement in a second embodiment;

FIG. 7 is a perspective view showing the terminal arrangement in a third embodiment;

FIG. 8 is a perspective view showing the terminal arrangement in a fourth embodiment;

FIG. 9 is a perspective view showing the terminal arrangement in a fifth embodiment;

FIG. 10 is a perspective view showing the terminal arrangement in a sixth embodiment;

FIG. 11 is a perspective view showing the terminal arrangement in a seventh embodiment;

FIG. 12 is a perspective view showing the terminal arrangement in an eighth embodiment;

FIG. 13 is a perspective view showing the terminal arrangement in a ninth embodiment;

FIG. 14 is a perspective view showing the terminal arrangement in a tenth embodiment; and FIG. 15 is a perspective view showing the terminal arrangement in an eleventh embodiment.

DETAILED DESCRIPTION OF THE PREFERRED EMBODIMENT

Figure 1:
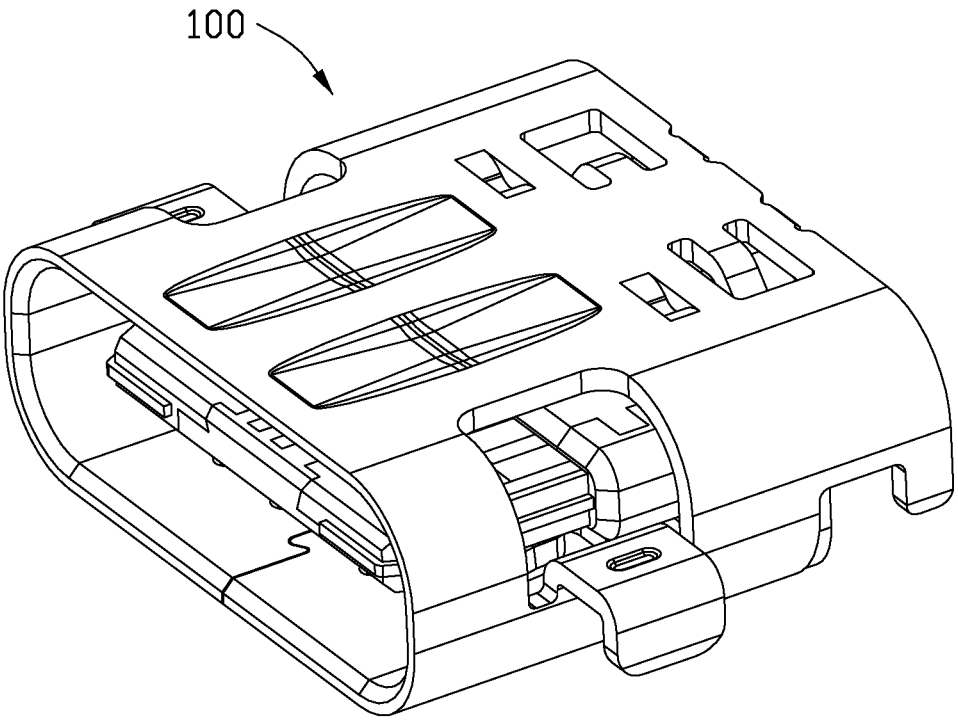
FIG. 1 is an assembled perspective view showing an electrical connector in accordance with a first embodiment of the present invention.
Figure 2:
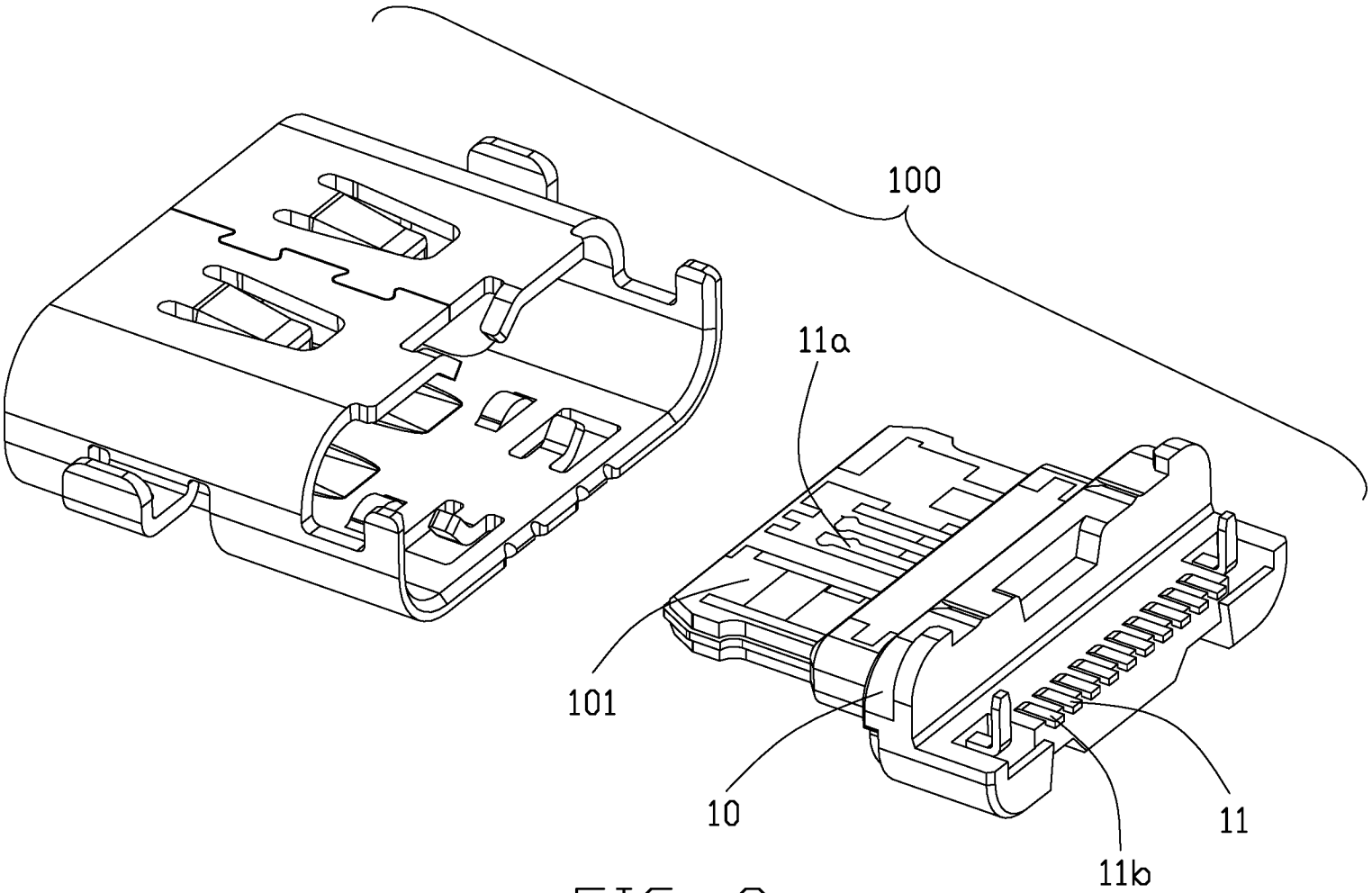
FIG. 2 is a partly exploded view showing the electrical connector.

Reference will now be made in detail to the preferred embodiment of the present invention. Referring to FIGS. 1-2 and 5-12, an electrical connector 100 shown is a receptacle connector and comprises an insulative housing 10 having a tongue portion 101 and two rows of terminals 11 affixed to the insulative housing 10. The two rows of terminals 11 are reversely-symmetrical to each other.

Each terminal 11 comprises a contact portion 11*a* exposed on the tongue portion 101 and a soldering portion 11*b*. The electrical connector 100 includes twelve terminal positions. Each row of terminals in the present invention include grounding terminal and power terminal and a vacant space between the grounding terminal and the power terminal.

In a first embodiment shown in FIG. 5, each row of terminals 11 include a subsidiary terminal, i.e., a detecting terminal in this embodiment, a USB 2.0 positive terminal, a USB 2.0 negative terminal, a power terminal and a grounding terminal in the fifth terminal position, the sixth terminal position, the seventh terminal position, the ninth terminal position, and the twelfth terminal position of the twelve terminal positions, in sequence. The vacant space is the tenth terminal position and the eleventh terminal position of the twelve terminal positions.

In a second embodiment shown in FIG. 6, each row of terminals 11 include a grounding terminal, a subsidiary terminal, i.e., a detecting terminal in this embodiment, a USB 2.0 positive terminal, a USB 2.0 negative terminal, and a power terminal in the first terminal position, the fifth terminal position, the sixth terminal position, the seventh terminal position, and the ninth terminal position of the twelve terminal positions, in sequence. The vacant space is the second terminal position, the third terminal position, the fourth terminal position and the eighth terminal position of the twelve terminal positions. The grounding terminal and the power terminal are arranged at a first district from a first terminal position to the ninth terminal position. The subsidiary terminal is arranged at a second district at the fifth terminal position. The first district is partly overlapped, and therefore connected with the second district.

In a third embodiment shown in FIG. 7, each row of terminals 11 include a power terminal, a subsidiary terminal, i.e., a detecting terminal in this embodiment, a USB 2.0 positive terminal, a USB 2.0 negative terminal, and grounding terminal in the fourth terminal position, the fifth terminal position, the sixth terminal position, the seventh terminal position, and the twelfth terminal position of the twelve terminal positions, in sequence. The vacant space is from the eighth terminal position to the eleventh terminal position of the twelve terminal positions. The grounding terminal and the power terminal are arranged at a first district from a fourth terminal position to the twelfth terminal position. The subsidiary terminal is arranged at a second district at the fifth terminal position. The first district is partly overlapped, and therefore connected with the second district.

In a fourth embodiment shown in FIG. 8, each row of terminals 11 include a grounding terminal, a power terminal, a subsidiary terminal, i.e., a detecting terminal in this embodiment, a USB 2.0 positive terminal, and a USB 2.0 negative terminal at the first terminal position, the fourth terminal position, the fifth terminal position, the sixth terminal position, and the seventh terminal position of the twelve terminal positions, in sequence. The vacant space is the second terminal position and the third terminal position of the twelve terminal positions. The grounding terminal and the power terminal are arranged at a first district from a first terminal position to the fourth terminal position. The subsidiary terminal is arranged at a second district at the fifth terminal position. The first district is connected with the second district.

In a fifth embodiment shown in FIG. 9, each row of terminals 11 include a grounding terminal, a power terminal, a subsidiary terminal, i.e., a detecting terminal in this embodiment, a power terminal, and a grounding terminal at the first terminal position, the fourth terminal position, the fifth terminal position, the ninth terminal position, and the twelfth terminal position of the twelve terminal positions, in sequence. The vacant space is the second terminal position and the third terminal position of the twelve terminal positions. The grounding terminal and the power terminal are arranged at a first district from a first terminal position to the fourth terminal position. The subsidiary terminal is arranged at a second district at the fifth terminal position. The first district is connected with the second district.

In a sixth embodiment shown in FIG. 10, each row of terminals 11 include a grounding terminal, a power terminal, two subsidiary terminals, i.e., a detecting terminal and a low-frequent audio terminal in this embodiment, another power terminal, and another grounding terminal in the first terminal position, the fourth terminal position, the fifth terminal position, the eighth terminal position, the ninth terminal position, and the twelfth terminal position of the twelve terminal positions, in sequence. The vacant space is the second terminal position and the third terminal position of the twelve terminal positions. The electrical connector 100 in this embodiment is a charger. The grounding terminal and the power terminal are arranged at a first district from a first terminal position to the fourth terminal position. The subsidiary terminal is arranged at a second district at a fifth terminal position. The first district is connected with the second district.

In a seventh embodiment shown in FIG. 11, each row of terminals 11 include a grounding terminal, a power terminal, a subsidiary terminal, i.e., a detecting terminal in this embodiment, a USB 2.0 positive terminal, a USB 2.0 negative terminal, a power terminal, and a grounding terminal in the first terminal position, the fourth terminal position, the fifth terminal position, the sixth terminal position, the seventh terminal position, the ninth terminal position, and the twelfth terminal position of the twelve terminal positions, in sequence. The vacant space is the second terminal position and the third terminal position of the twelve terminal positions. The grounding terminal and the power terminal are arranged at a first district from a first terminal position to the fourth terminal position. The subsidiary terminal is arranged at a second district at a fifth terminal position. The first district is connected with the second district.

In an eighth embodiment shown in FIG. 12, each row of terminals 11 include a grounding terminal, a power terminal, a detecting terminal, a USB 2.0 positive terminal, a USB 2.0 negative terminal, a low-frequency audio terminal, a power terminal, and a grounding terminal in the first terminal position, the fourth terminal position, the fifth terminal position, the sixth terminal position, the seventh terminal position, the eighth terminal position, the ninth terminal position, and the twelfth terminal position of the twelve terminal positions, in sequence. The vacant space is the second terminal position and the third terminal position of the twelve terminal positions. Both the detecting terminal and the low-frequency audio terminal are subsidiary terminals. The grounding terminal and the power terminal are arranged at a first district from a first terminal position to the fourth terminal position. The subsidiary terminal is arranged at a second district at a fifth terminal position. The first district is connected with the second district.

Figure 3:
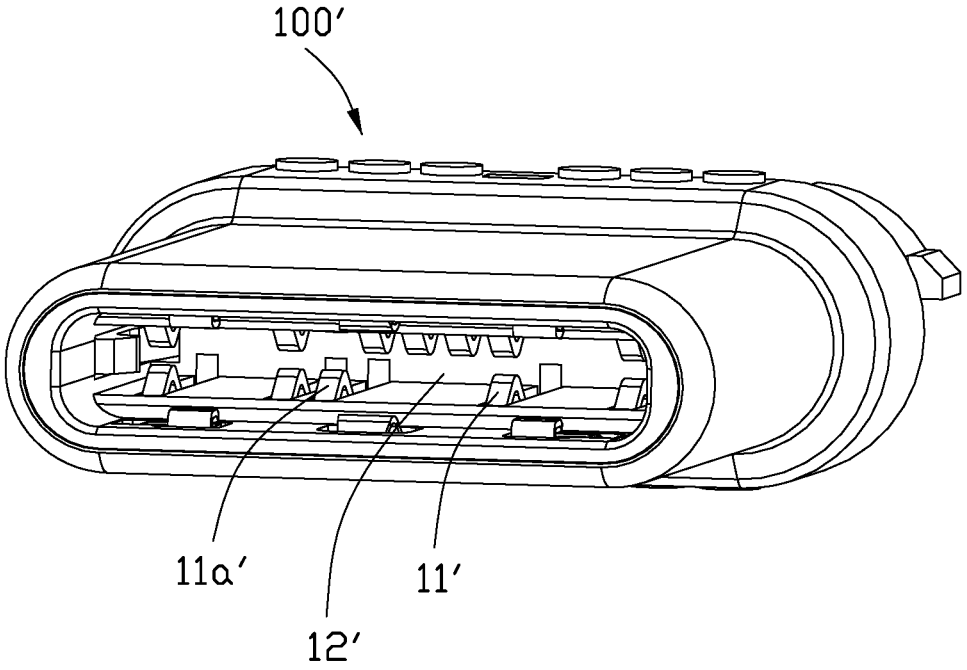
FIG. 3 is an assembled perspective view showing the electrical connector referred in a ninth embodiment.
Figure 4:
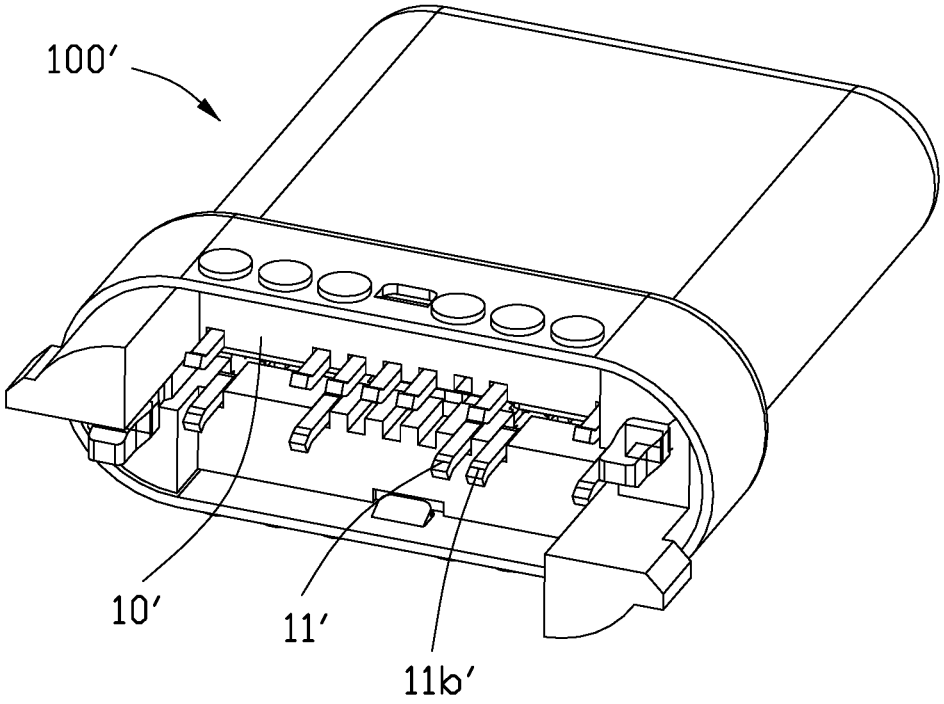
FIG. 4 is another view similar to FIG. 3, taken from another aspect.

Referring to FIGS. 3-4 and 13-15, the electrical connector 100' in the ninth, the tenth and the eleventh embodiment refers to a plug connector adapted for being normally or reversely inserted into mating receptacle connector. The electrical connector 100' includes an insulative housing 10' defining an insertion cavity 12', and a first row and a second row of terminals 11' affixed to the insulative housing 10'. Each terminal 11' is formed with a curved contacting portion 11*a*' and a soldering portion 11*b*'. The insertion cavity 12' of the electrical connector 100' includes twelve terminal positions.

In the ninth embodiment shown in FIG. 13, the first row of terminals 11' include a first grounding terminal, a first power terminal, a USB 2.0 positive terminal, a USB 2.0 negative terminal, a subsidiary terminal, i.e., a lower-frequency terminal in this embodiment, a second power terminal, and a second grounding terminal positioned at the first terminal position, the fourth terminal position, the sixth terminal position, the seventh terminal position, the eighth terminal position, the ninth terminal position, and the twelfth terminal position. The second row of terminals 11' include a first grounding terminal, a first power terminal, a lower-frequency terminal, a second power terminal, a second grounding terminal positioned at the first terminal position, the fourth terminal position, the eighth terminal position, the ninth terminal position, and the twelfth terminal position. Since two rows of the terminals in the receptacle connector respectively include reversely-symmetrically arranged USB 2.0 positive terminal and the USB 2.0 negative terminal, only one row of terminals in the plug connector is formed with the USB 2.0 positive terminal and the USB 2.0 negative terminal and such a plug connector is adapted for being inserted into the receptacle connector. The vacant space includes a first vacant space at the second terminal position and the third terminal position of the twelve terminal positions, and a second vacant space at the tenth terminal position and the eleventh terminal position of the twelve terminal positions. The subsidiary terminal refers to the low-frequency terminal adjacent to the second power terminal. The grounding terminal and the power terminal are arranged at a first district from a ninth terminal position to the twelfth terminal position. The subsidiary terminal is arranged at a second district at the eighth terminal position. The first district is connected with the second district.

Referring to the tenth embodiment shown in FIG. 14, each row of terminals 11' include a first grounding terminal, a first power terminal, a subsidiary terminal, i.e., a detecting terminal in this embodiment, a second power terminal, and a second grounding terminal positioned at the first terminal position, the fourth terminal position, the fifth terminal position, the ninth terminal position, and the twelfth terminal position of the twelve terminal positions. The vacant space includes a first vacant space at the second terminal position and the third terminal position, and a second vacant space at the tenth terminal position and the eleventh terminal position of the twelve terminal positions. The grounding terminal and the power terminal are arranged at a first district from a first terminal position to the fourth terminal position. The subsidiary terminal is arranged at a second district at the fifth terminal position. The first district is connected with the second district.

Referring to the eleventh embodiment shown FIG. 15, each row of terminals 11' include a first grounding terminal, a first power terminal, a subsidiary terminal, i.e., a low-frequency terminal in this embodiment, a second power terminal, and a second grounding terminal positioned at the first terminal position, the fourth terminal position, the eighth terminal position, the ninth terminal position, and the twelfth terminal position of the twelve terminal positions. The vacant space includes a first vacant space at the second terminal position and the third terminal position of the twelve terminal positions, and a second vacant space at the tenth terminal position and the eleventh terminal position of the twelve terminal positions. The grounding terminal and the power terminal are arranged at a first district from the ninth terminal position to the twelfth terminal position. The subsidiary terminal is arranged at a second district at the eighth terminal position. The first district is connected with the second district.

In the first through the eleventh embodiment shown in FIG. 5 to FIG. 15, the subsidiary terminal in the first row of terminals is offset to that in the second row of terminals. Each row of terminals lack of at least two terminals to thereby form the vacant space between the grounding terminal and the power terminal. The vacant space is equivalent to or larger than two terminal positions. The subsidiary terminals in two rows are offset with each other along an up-to-down direction.

In FIGS. 5 to 15, "GND" designates the grounding terminal; "Vbus" designates the power terminal; "CC1" and "CC2" designate the detecting terminals; "D-" designates the USB 2.0 negative terminal; "D+" designates the USB 2.0 positive terminal; "RFU1" and "RFU2" designate the low-frequency terminals. It is noted that in the instant application, there are twelve positions in each row wherein the first position, the second position, the third position and the fourth position commonly form a first district, and the ninth position, the tenth position, the eleventh position and the twelfth positions commonly form another first district as well. The remaining fifth position, sixth position, seventh position and eighth position commonly form a second district between the first district and another first district. In other words, the twelve positions are arranged with three sets each having four positions wherein the middle/inner set forms the second district, and each of the two outer set by two sides of the middle/inner set forms the first district.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a tongue portion; and two rows of terminals being reversely-symmetrically arranged at opposite faces of the tongue portion, each row of terminals being disposed in some of twelve positions which are arranged with two outer sets and one inner set each having four positions, wherein each of the two outer sets defines a first district and the inner set defines a second district, each row of terminals comprising a grounding terminal and a power terminal arranged at said first district, and at least one subsidiary terminal arranged at said second district, each row of terminals lacking of at least two terminals to thereby form a vacant space between said grounding terminal and the power terminal, said subsidiary terminals in the two rows being offset with respect to each other along an up-to-down direction; wherein the contact tails of all terminals are arranged in one row with equal intervals.

2. The electrical connector as claimed in claim 1, wherein said at least one subsidiary terminal includes a detecting terminal arranged at the fifth terminal position in the twelve terminal positions.

3. The electrical connector as claimed in claim 2, wherein each row of terminals include a USB 2.0 positive signal terminal and a USB 2.0 negative signal terminal respectively positioned at the sixth terminal position and the seventh terminal position of the twelve terminal positions.

4. The electrical connector as claimed in claim 3, wherein said grounding terminal is positioned at the first terminal position or the twelfth terminal position of the twelve terminal positions.

5. The electrical connector as claimed in claim 3, wherein said power terminal is positioned at the fourth terminal position or the ninth terminal position of the twelve terminal positions.

6. The electrical connector assembly as claimed in claim 3, wherein each row of terminals comprise another grounding terminal and another power terminal, said two grounding terminals respectively arranged at the first terminal position and the twelfth terminal position, said two power terminals respectively arranged at the fourth terminal position and the ninth terminal position.

7. The electrical connector assembly as claimed in claim 6, wherein said at least one subsidiary terminal further comprises a low frequency audio terminal arranged at the eighth terminal position of the twelve terminal positions.

8. The electrical connector as claimed in claim 2, wherein each row of terminals comprise another grounding terminal and another power terminal, said two grounding terminals respectively arranged at the first terminal position and the twelfth terminal position, said two power terminals respectively arranged at the fourth terminal position and the ninth terminal position.

9. The electrical connector as claimed in claim 8, wherein said at least one subsidiary terminal further comprises a low frequency audio terminal arranged at the eighth terminal position of the twelve terminal positions.

10. An electrical connector comprising:

an insulative housing having an insertion cavity defining twelve terminal positions at opposite sides; and two rows of terminals arranged at the opposite sides of the insertion cavity, each terminal having a curved contact portion, each row of terminals comprising a first and a second grounding terminals, a first and a second power terminals, and a subsidiary terminal arranged adjacent to a middle of the insertion cavity along a transverse direction, each row of terminals lacking of two terminals to thereby form a first vacant space between the first grounding terminal and the first power terminal, and lacking of another two terminals to thereby form a second vacant space between the second grounding terminal and the second power terminal, said subsidiary terminals in the two rows being offset and reversely-symmetrically arranged; wherein the contact tails of all terminals are arranged in one row with equal intervals.

11. The electrical connector as claimed in claim 10, wherein said first and second grounding terminals are respectively arranged at the first terminal position and the twelfth terminal position, and said first and second power terminals respectively arranged at the fourth terminal position and the ninth terminal position.

12. The electrical connector assembly as claimed in claim 11, wherein said subsidiary terminal is a low frequency audio terminal arranged at the eighth terminal position of the twelve terminal positions.

13. The electrical connector as claimed in claim 12, wherein one row of the two rows of terminals comprise a USB 2.0 positive signal terminal and a USB 2.0 negative signal terminal respectively positioned at the sixth terminal position and seventh terminal position of the twelve terminal positions.

14. The electrical connector as claimed in claim 11, wherein said subsidiary terminal includes a detecting terminal arranged at the fifth terminal position of the twelve terminal positions.

* * * * *